United States Patent [19]

Reist

[11] Patent Number: 4,577,855

[45] Date of Patent: Mar. 25, 1986

[54] APPARATUS AND METHOD FOR REMOVING AND CONVEYING AWAY A SAMPLE COPY FROM AN ORDERLY FLOW OF PRINTED PRODUCTS

[75] Inventor: Walter Reist, Hinwil, Switzerland

[73] Assignee: Feramatic AG, Hinwil, Switzerland

[21] Appl. No.: 576,472

[22] Filed: Feb. 2, 1984

[30] Foreign Application Priority Data

Feb. 2, 1983 [CH] Switzerland ..... 589/83

[51] Int. Cl.[4] ..... B65H 29/04

[52] U.S. Cl. ..... 271/281; 271/204; 271/265; 271/277

[58] Field of Search ..... 271/280, 281, 282, 258, 271/265, 277, 204, 206

[56] References Cited

U.S. PATENT DOCUMENTS

| | | | |
|---|---|---|---|
| 4,201,286 | 5/1980 | Meier | 271/277 X |
| 4,276,978 | 7/1981 | Deguchi | 271/204 X |
| 4,320,894 | 3/1982 | Reist | 271/277 |

FOREIGN PATENT DOCUMENTS

| | | | |
|---|---|---|---|
| 2518373 | 12/1975 | Fed. Rep. of Germany | 271/204 |
| 2820957 | 12/1978 | Fed. Rep. of Germany . | |
| 2206748 | 6/1974 | France . | |
| 538065 | 7/1973 | Switzerland . | |

*Primary Examiner*—Richard A. Schacher

*Attorney, Agent, or Firm*—Roylance, Abrams, Berdo & Goodman

[57] ABSTRACT

A system removes and conveys a sample copy from a fast moving, orderly material flow of printed materials without disturbing the other products in the material flow. The apparatus includes a power driven conveyor and a conveying chain mounted on guide pulleys, with one of the pulleys located adjacent the material flow. A gripper is coupled to the chain and has a cushioning spring. A cushioning clamp engages and pretensions the cushioning spring to engage a selected sample copy. A control regulates operation of the gripper and clamp in response to detection of individual products and their speed.

20 Claims, 7 Drawing Figures

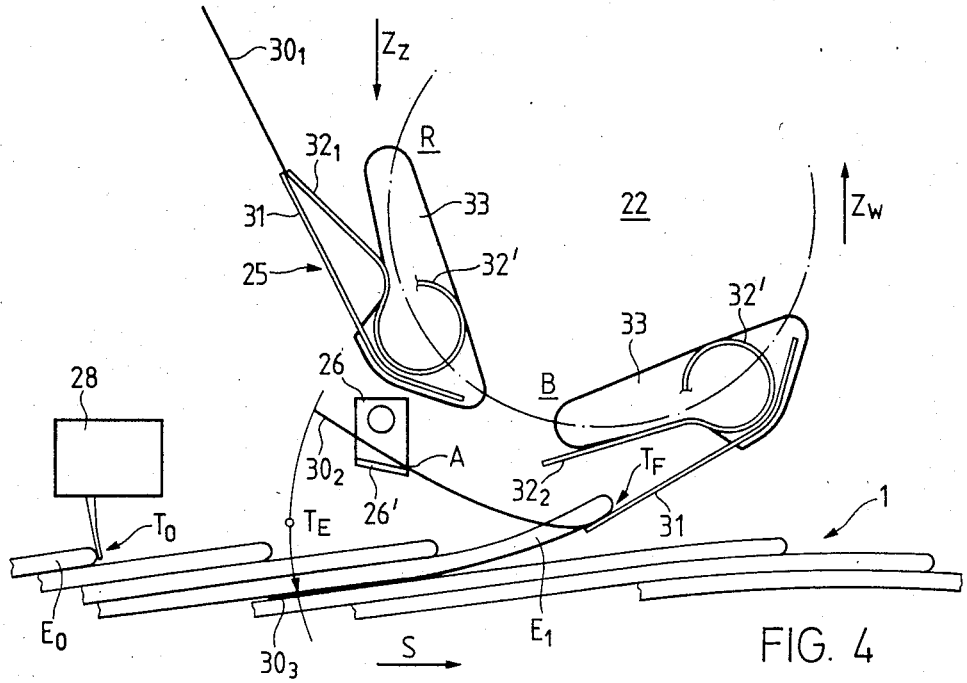
FIG. 4
FIG. 5
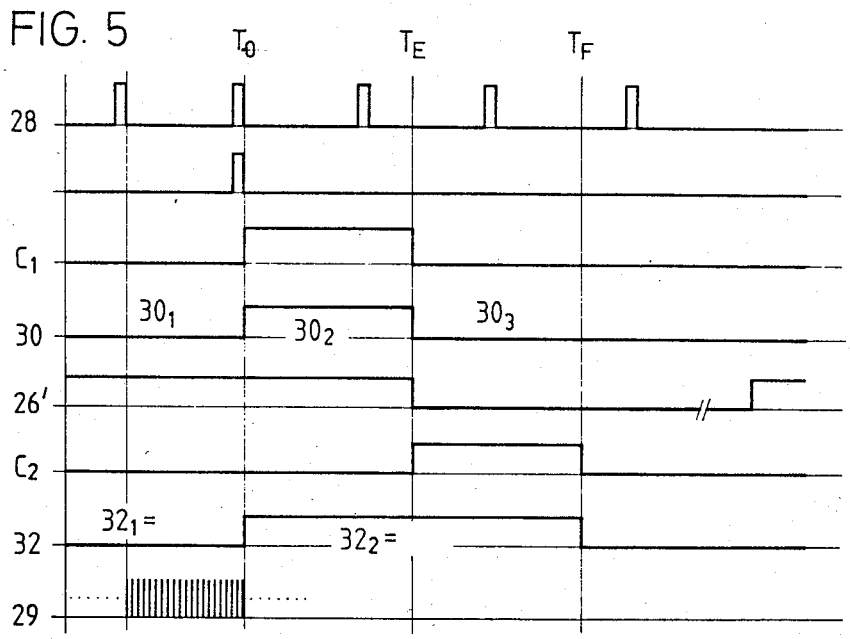

APPARATUS AND METHOD FOR REMOVING AND CONVEYING AWAY A SAMPLE COPY FROM AN ORDERLY FLOW OF PRINTED PRODUCTS

FIELD OF THE INVENTION

The present invention relates to a method and apparatus for use in a mass production system. More particularly, the present invention relates to a method and apparatus for removing and conveying away a sample copy from an orderly material flow of printed products.

BACKGROUND OF THE INVENTION

The manufacture of products normally involves monitoring production by taking and examining random samples from the flow of products. Sample copies can generally be removed from an unorderly product flow without special restrictions. However, in an orderly product flow, the degrees of freedom for removing the sample copy are significantly reduced, particularly since the removal of the sample copy must not disturb the order of the product flow during the sample removal.

The problems with conventional systems are particularly acute in rapidly performed production processes. Due to their high output, intermediate buffer storage cannot be provided in rapidly performed production systems so that strict synchronism must be maintained.

The transfer of semi-finished and finished products from station to station is greatly dependent on the working cycle. For orderly product flow, a disturbance to the order in one station is conveyed downstream in the operation at the speed imparted by the working cycle of the process to that point. Such disturbance causes a buildup of material. Based on experience, this buildup only lasts a few seconds, and it is unnecessary to stop the process temporarily for removal of the accumulation.

In the orderly material flows in the production of printed products, an order is established that permits the individual products to be picked up separately. Disturbances in the order of the material flow adversely affect the synchronism and can cause serious accumulations of material. Thus, interferences in fast stream flows are always critical to the processes.

For example, a rotary printing system has a standard output of 50,000 to 100,000 copies per hour. In such system, a sample copy should be removed as quickly as possible after the copy has been printed. Preferably, the removal of the sample copy should not interfere with the stream flow in the critical processing section between delivery and the individual picking up. Thus, the sample copies are removed from a less critical processing section in conventional systems.

At rotary printing production speeds, deficiencies must be detected and corrected early. Otherwise, thousands of faulty copies will be produced. Thus, it is desirable to minimize the time between production of an individual product and its examination.

SUMMARY OF THE INVENTION

An object of the present invention is to provide an apparatus and method for removing and conveying away a sample copy from an orderly material flow of printed products without interfering with the product steam flows even at high flow rates, and without causing downstream problems.

Another object of the present invention is to provide an apparatus and method for removing and conveying away a sample copy from an orderly material flow of printed products where the sample copy can be transferred to a random point for evaluation.

A further object of the present invention is to provide an apparatus and method for removing and conveying away a sample copy from an orderly material flow of printed products which can be employed on fast stream flows and which permit a sample copy to be rapidly transferred over given topological conditions, such that the time between production and evaluation of the product is significantly reduced, compared to conventional sample copy removal systems.

A still further object of the present invention is to provide an apparatus and method for removing and conveying away a sample copy from an orderly material flow of printed products whereby the removal can be performed reliably, even in the presence of divergences within the stream formation.

The foregoing objects are obtained by an apparatus for removing and conveying away a sample copy from an orderly material flow of printed products, comprising a power driven conveyor for conveying an orderly flow of printed products. A conveying chain is mounted on guide pulleys with one of the pulleys located adjacent the material flow. A first gripper is coupled to the chain and has a cushioning spring. A cushioning clamp is releasably coupled to the cushioning spring. A control mechanism regulates operation of the gripper and the clamp in response to detection of individual products and their speed on the conveyor.

The foregoing objects are also obtained by a method for removing and carrying away a sample copy from an orderly material flow of printed products, comprising the steps of conveying a discrete material flow of flat products along a longitudinal axis on a power driven conveyor, detecting the material flow, associating a sample product in the material flow with a deflection means, deflecting the sample product with the deflection means into an open gripper, operating the gripper to fix the sample product therein, and accelerating the gripper and the sample product therein during an acceleration phase along a path having a continuously increasing angle relative to the material flow longitudinal axis. The path is defined by the front edge of the sample product.

By forming the apparatus and conducting the method in this manner, a sample copy can be easily and simply removed from a relatively fast, orderly material flow without disturbing the flow for downstream processing. Thus, the method and apparatus of the present invention provides a rapid and efficient system for removing a sample copy for evaluation at an early stage of production.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 4 is a side elevational view of the operation of the system of FIG. 2;

FIG. 5 is a graphic representation of the removal process according to the system of FIG. 2.

DETAILED DESCRIPTION OF THE PREFERRED EMBODIMENT

Figure 1:
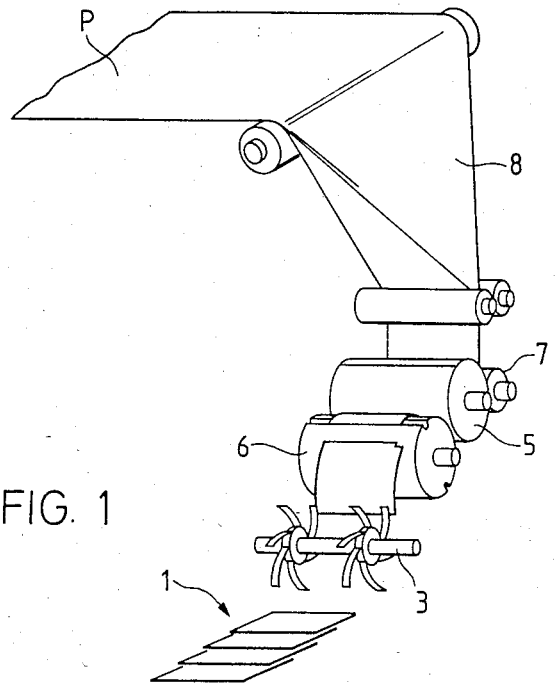
FIG. 1 is a partial, perspective view of a printing system producing an orderly material flow of flat products of the type in which the present invention is employed.

FIG. 1 illustrates the overall production system for producing flat products of the type in which the present invention is employed. In this exemplary system, the printed product can be a newspaper which is folded, cut, delivered and conveyed. Conventionally, a printed paper web P is folded over a hopper 8, is cut by a cutting cylinder 7, and then refolded between folding cylinders 5 and 6. Subsequently, the printed products are transferred by a delivery turning star 3 to form a stream flow 1 dependent upon the delivery and removal speed. The exemplary system involves a folded layout with two folding processes.

The stream flow 1 moves from the delivery turning star at a relatively high rate to downstream stations for further processing. The continuous material flow is converted into a discontinuous or discrete material flow with the aid of a cutting mechanism. The production process can be evaluated by sampling for the first time just downstream of delivery turning star 3. At this point, the processing can be regulated and controlled for the first time. This is particularly important in rapidly performed production processes.

A sample copy is desirably taken from the stream flow at a high conveying speed in close proximity to delivery turning star 3. The removal of the sample copy must not cause a significant change in the formation of the products in the stream flow. This requires a correspondingly precise coordination of the removal system. Only the specific moment of the removal of the sample copy should the gripper engage the stream flow. At other times, no operative connection should exist between the removal apparatus and the material flow.

Figure 2:
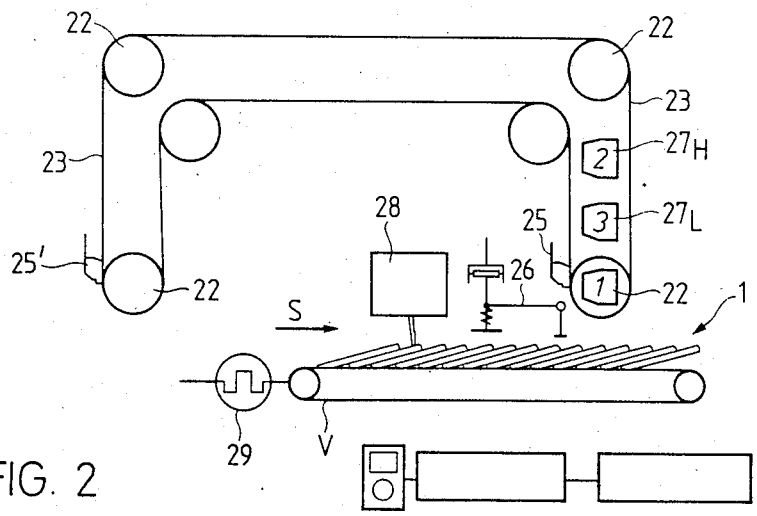
FIG. 2 is a schematic, side elevational view of a removing and conveying system according to the present invention.

Referring now to FIG. 2, the removal and conveying system is illustrated diagramatically. Flow stream 1 is conveyed on a conveyor belt V in the direction of arrow S. In its rest position, a gripper 25 is positioned above the stream flow, while a second gripper 25' is simultaneously located at the delivery point of a target location. A cushioning spring clamp 26 initiates the mechanical removal process and is also located adjacent the material flow. Position detectors $27_H$ and $27_L$ supply information regarding the position of conveying chain 23. A tachogenerator 29 provides information on the speed of the conveyor belt driving the stream flow. Finally, an association detector 28 provides information to the system regarding the sample copy to be removed for evaluation.

In operation, the removal process is initiated by a start key at a target location which can be located at a considerable distance from the removal point. Gripper 25 is readied with the aid of cushioning spring clamp 26. Simultaneous with operation of the start key, association detector 28 detects a copy in the stream flow, i.e., the association detector provides information to the readied gripper of the passage of one of numerous copies. Tachogenerator 29 provides information for tracking the course of the detected copy toward gripper 25.

At a predetermined time, clamp 26 releases gripper 25 for the gripping process such that the sample copy is picked up mechanically by the gripper and carefully removed from the stream flow at a high speed, and then conveyed to the target location at a reduced speed.

Second gripper 25' originally at the target location, then assumes the position of previously active gripper 25. By repeating actuation of the start key, another removal process can be initiated.

Figure 3A:
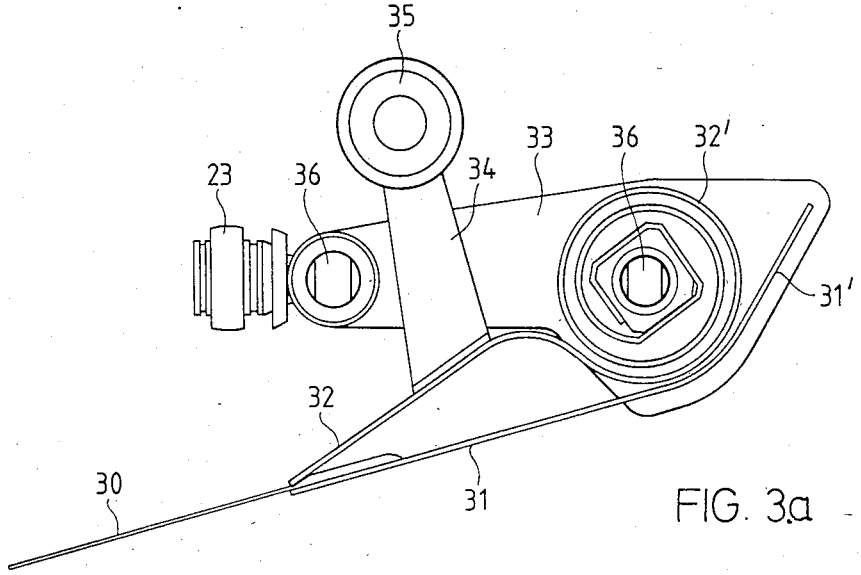
FIG. 3*a* is an enlarged, side elevational view of a gripper of the system of FIG. 2.
Figure 3B:
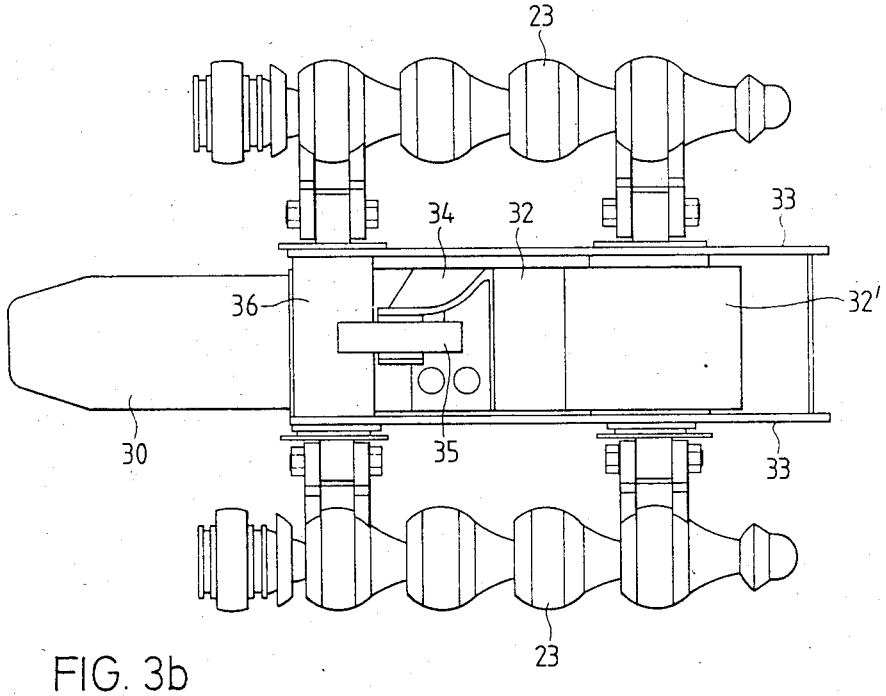
FIG. 3*b* is a top plan view of the gripper of FIG. 3*a;*

The details of gripper 25 and gripper 25' are illustrated in FIGS. 3*a* and 3*b*. Gripper 25 must operate rapidly and precisely to remove reliably a sample copy from the stream flow. The gripper comprises a cushioning spring 30 which deflects the sample copy from the stream flow. A gripping spring 32 with an elasticity-improving spiral part 32' and a counter spring 31 with a mounting support 31' provide a gripping mechanism. The gripping mechanism is operated by a gripping or clamping lever 34. Gripping lever 34 moves clamping spring 32 and is operated by a suitable rocker arm connected to gripping lever roller 35. Two spacer shafts 36 maintain the spacing between two gripper side surfaces 33. Gripper 25 is coupled to conveying chains 23 such that it has several spacial degrees of freedom of movement. Two conveying chains 23 are provided for the grippers as illustrated in FIG. 3*b*.

Since gripper 25 is attached on each side to a three-dimensionally movable conveying chain 23, the gripper can work and overcome difficult typographies. The spade-like cushioning spring 30 is connected to gripping springs 31 and 32 and covered by spacer shaft 36. Gripping lever 34 for gripping spring 32 supports gripping lever roller 35 in a slightly angularly offset manner.

The corresponding dimensions are determined by the products being manipulated. For small, light products, a correspondingly small gripper is provided and the conveying chain is arranged symmetrically relative to the center of the gripper. Random rotatability about the conveying chain longitudinal axis advantageously overcomes topologically difficult conveying paths.

Referring now to FIG. 4, the operation of the system for removing a sample copy from the stream flow is illustrated. The path of a point located on the longitudinal axis of spacer shaft 36 for spiral spring 32' forms a circle when moved in direction $Z_z$ about guide pulley 22. FIG. 4 illustrates gripper 25 in two different operating positions and cushioning spring 30 in three different operating positions denoted by $30_1$, $30_2$ and $30_3$.

Gripper 25 is in rest position R as long as the system is not initiated to remove a sample copy. Upon depressing a starting device, e.g., a start key at the target location, gripper 25 is moved to the ready position B. In the ready position of the gripper cushioning spring $30_1$ is pretensioned against movable or controllable member 26' of cushioning spring clamp 26 by being oriented in a bent position. Simultaneously, gripping lever 34 tensions gripping springs 31 and $32_2$. With cushioning spring $30_2$ is its readied position under spring tension, it is ready to move quickly to deflect a sample copy to the gripper for clamping by moving to its relaxed position, where it also serves as a receptacle for the received sample copy.

As gripper 25 moves in an inching process to the ready position B upon initiation of the release process at the target location, association detector 28 has electronically "detected" a sample copy $E_o$ at time $T_o$. The selected sample copy is conveyed on the conveyor within the stream flow until time $T_E$ when cushioning spring clamp 26 moves member 26' away from pretensioned cushioning spring $\mathbf{30}_2$ such that cushioning spring $\mathbf{30}_2$ engages the material flow just before the folded side of sample copy $E_o$. Due to the pretensioning of cushioning spring 30, movement of the spring from the position denoted by $\mathbf{30}_2$ to the position denoted by $\mathbf{30}_3$ takes place relatively suddenly such that the part of the material stream formation passes over cushioning spring $\mathbf{30}_3$ and the cushioning spring acts as a receptacle or guide toward the open gripper.

When sample copy $E_1$ at time $T_F$ has reached a position between springs $\mathbf{32}_2$ and 31 of gripper 25, the gripper closes and removes the sample copy from the stream formation. The gripper then accelerates the copy in the direction $Z_w$.

The acceleration of the copy must be initially in the direction S of the stream flow, and must be relatively large such that inertia forces of the copies, in adhesion and sliding friction contact with the selected sample copy $E_1$, are greater than the frictional forces. In this manner, the sample copy can be removed without disturbing the other copies in the flow. Acceleration values of between 300 and 800 meters per second are adequate for a newspaper conveyed at a speed of 4 meters per second. The stream flow conveys 60,000 to 80,000 copies per hour with a spacing between the copies in the stream of approximately 80 millimeters.

FIG. 5 graphically illustrates the relative timing sequence of the removal operation of the present invention. Time is presented on the horizontal axes. The cycle times of association detector 28, two electronic counters $C_1$ and $C_2$, gripping and cushioning springs 30 and 32 of gripper 25 and member 26' of cushioning spring clamp 26 are illustrated. The speed-dependent pulses generated by tachogenerator 29 are illustrated on the lowest time axis between two copy pulses of association detector 28. This illustrates the manner in which a "detected" copy is monitored on its way to the gripper.

The gripping and conveying process is initiated by a starting pulse generated at a target location, as is in the case of the present example. Association detector 28 detects each individual copy in the stream flow. If no starting pulse has been generated to specify that a particular copy should be evaluated, all copies continue to pass on the conveyor. At time $T_o$, the starting pulse causes detection and monitoring of the selected sample copy to be extracted. Counter $C_1$ is actuated to count the tachogenerator pulses corresponding to the time when the sample copy will strike the cushioning spring at point $T_E$. At this point, counter $C_1$ causes movement of member 26' and activation of second counter $C_2$. Counter $C_2$ counts the number of tachogenerator pulses corresponding to a time required for the sample copy to be deflected up spring 30 into the gripper between springs 31 and 32 at time $T_F$. At time $T_o$, gripping spring 32 can be tensioned by gripping lever 34. However, tensioning of gripping spring 32 can also occur when gripper 25 is brought to ready position B.

When the folded edge of the sample copy which had been scanned at time $T_o$ reaches the gripper at counted time $T_F$, the counter initiates closing of gripper springs 31 and 32 and initiates the acceleration process. In this manner, the mechanically engaged sample copy is removed from the stream flow.

Following the extraction acceleration, the sample copy is conveyed at the processing speed to the target location. Second gripper 25', originally located at the target location, is simultaneously located adjacent the stream flow. Additional grippers 25'' can be provided over the entire length of the conveying chain. More than one target location can also be provided for the gripper. Thus, a starting pulse from a newspaper editor's office could convey a sample copy directly to the editor. In contrast, the printer stops the sample copies at the target location for checking the print in conventional systems.

The present printing systems produce about $10^5$ copies per hour. Continuous increases must be expected. The extraction acceleration for the sample copies must be adaptable to developments in increasing production speed. The present invention is adaptable to the developing and increasing production speeds. High kinetic forces occur as a function of the degree of pulse change when accelerating an inert mass. In the present situation, the necessary forces are supplied from a power mechanism through conveying chain 23 to the gripper. Maximize rigidity in this system is necessary and desired. Acceleration and counteracting factors, such as cable elongation and cable split must be minimized, without restricting the conveying characteristics of the chain for overcoming difficult typographies. Such conditions are satisfied by using an articulated cable as disclosed in Swiss Pat. No. 538,065 for conveying chain 23. The disclosure of such Swiss patent is hereby incorporated by reference.

Figure 6:
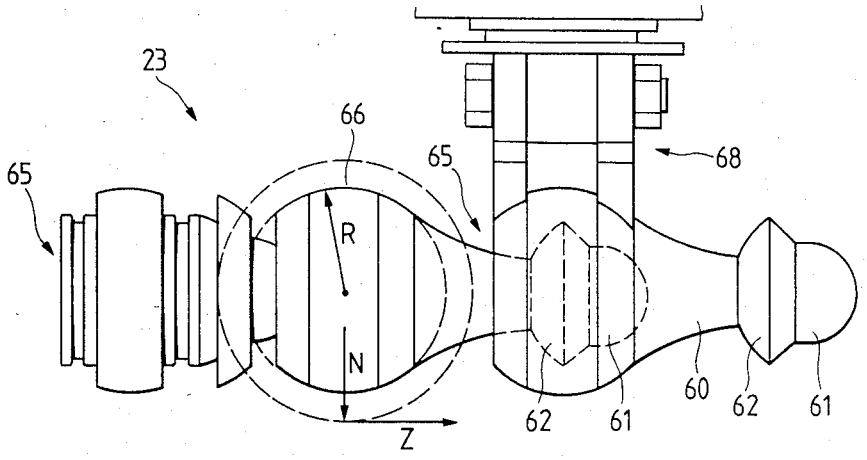
FIG. 6 is a partial, top plan view of the conveying chain of the system of FIG. 2.

FIGS. 3*b* and 6 illustrate portions of conveying chain 23. The chain comprises a plurality of chain elements 60. Each chain element 60 comprises a screwable plug-socket arrangement with a plug seat 61 pivotally inserted within a socket 65 of an adjacent chain element. A locking sleeve 62 prevents separation of the plug seat 61 from the adjacent socket 65 under a tension load. Two interconnected chain elements are freely rotatable about their connection and can be pivoted up to an angle limited by its construction. The simultaneous pivoting and rotational movement between the elements permits freedom of movement within the envelope defined by the curve of a cone. Plug seat 61 forms a sliding seat such that the finished train has no slack, but has great mobility. The extensibility of the chain results merely from the material used. Chains formed of polypropylene avoid disadvantageous elongation, while providing good sliding characteristics and excellent toughness.

Each chain element has a convex seat 66 which is partially spherical and has a radius R. The generally spherical shape is emphasized in the drawing by the circles found by two broken lines. The larger circle merely serves to better accentuate this characteristic. Arrow N indicates a normal or contact pressure, while arrow Z indicates a tensile force. The convex seat on each chain element is placed in a concave seat in the guide and drive pulleys 22. This arrangement provides a temporary positive connection between the convex seat 66 pressed with a force in the direction N into the concave seat of the pulley and tensioned in direction Z. This connection is completely slip-free, and is therefore, very suitable for high accelerations with negligible extension. Nevertheless, this chain provides adequate mobility for rapidly succeeding deflections at optimum times about the chain axis.

The generally spherical construction of the convex seat permits tensioning in both direction due to its symmetry. If the chain is to be tensioned in only one direction, the seat can be constructed with flanks favoring forces in the tensioning direction. However, the resulting asymmetry of the convex seat must be rotationally symmetrical in the axial rotation due to the required rotary mobility of the chain elements.

As illustrated in FIGS. 3*b* and 6, the gripper can be fixed with a fastening 68 to one or more of chain elements 60. This three-dimensional chain permits the gripper to be conveyed over even the most difficult typographies. As soon as a gripper is detected in a rest position R over stream flow 1, the removal process can be initiated by a starting pulse at any one of the target locations.

The method and apparatus of the present invention can be employed for any flat products moved in discrete form. The stream flow is not required, although it is preferred. By means of the detecting, associating, cushioning spring engagement, gripping and removal steps of the method of the present invention, it is also possible to detect and remove loosely, successively circulating copies and to convey such copies to a target location.

In the printing field, the present invention will reduce removal and appraisal time of sample copies by a factor between about 10 and 20. In production rates of 90,000 copies per hour, there can be 25 faulty or inadequate copies per second. At such level, sample removal immediately adjacent the production process and at a high conveying speed will represent a factor which will greatly reduce production costs.

While a particular embodiment has been chosen to illustrate the invention, it will be understood by those skilled in the art that various changes and modifications can be made therein without departing from the scope of the invention as defined in the appended claims.

What is claimed is:

1. An apparatus for removing and conveying away a sample copy from an orderly imbricated material flow of printed products, comprising:

a power driven conveyor for conveying an orderly imbricated flow of printed products;

a conveying chain mounted on guide pulleys, one of said pulleys located adjacent the material flow;

a first gripper coupled to said chain, said gripper having relatively movable first and second gripping members and an elongated, flexible cushioning spring extending from said first gripping member, said cushioning spring being bendable about an axis transverse to a longitudinal axis thereof and being movable between a ready position in which said cushioning spring is bent and pretensioned such that a free end of said cushioning spring is biased toward said conveyor and a guiding position in which said free end engages the material flow to guide the sample copy between said gripping members;

a cushioning spring clamp releasably coupled to said cushioning spring for maintaining said cushioning spring in said ready position; and control means for regulating operation of said gripper and said clamp in response to detection of individual products and speed thereof.

2. An apparatus according to claim 1 wherein said control means comprises an association detector adjacent said conveyor, a tachogenerator coupled to said conveyor and pulse counting means operatively connected to said tachogenerator.

3. An apparatus according to claim 2 wherein said clamp comprises a movable member engaged by said cushioning spring to pretension said cushioning spring.

4. An apparatus according to claim 1 wherein said clamp comprises a movable member engaged by said cushioning spring to pretension said cushioning spring.

5. An apparatus according to claim 4 wherein a second gripper is coupled to said chain spaced from said first gripper.

6. An apparatus according to claim 3 wherein a second gripper is coupled to said chain spaced from said first gripper.

7. An apparatus according to claim 2 wherein a second gripper is coupled to said chain spaced from said first gripper.

8. An apparatus according to claim 1 wherein a second gripper is coupled to said chain spaced from said first gripper.

9. An apparatus according to claim 1 wherein said chain comprises a plurality of interconnected chain elements, each of said elements having a socket, a plug seat with a locking sleeve and a convex seat, each said plug seat being received in the socket of an adjacent chain element and secured therein by said locking sleeve.

10. An apparatus according to claim 9 wherein said convex seat is generally spherical.

11. An apparatus according to claim 9 wherein said convex seat is generally aspherical.

12. An apparatus according to claim 1 wherein said gripping members are biased toward each other by spring means.

13. A method for removing and carrying away a sample copy from an orderly material flow of printed materials, comprising the steps of:

conveying a discrete imbricated material flow of flat products along a longitudinal axis on a power driven conveyor;

detecting the material flow;

associating a sample product in the material flow with a deflection means;

deflecting the sample product with the deflection means into an open gripper by bending and prestressing an elongated and flexible cushioning spring against a cushioning spring clamp to bias a free end of the cushioning spring toward the material flow, and then by releasing the cushioning spring from the cushioning spring clamp such that the cushioning spring free end moves rapidly against the material flow in front of the sample product to guide the sample product into the open gripper;

operating the gripper to fix the sample product therein; and accelerating the gripper with the cushioning spring and with the sample product therein during an acceleration phase along a path having a continuously increasing angle relative to the material flow longitudinal axis, the path being defined by a front edge of the sample product.

14. A method according to claim 13 wherein the sample product is conveyed to a target location at approximately a speed reached at the end of the acceleration phase.

15. A method according to claim 14 wherein pulses dependent upon material flow speed on the conveyor are generated, the pulses being counted, after detection of the material flow and association of the sample product with the deflection means, for operating the deflection means, and subsequently being counted for operating the gripper to engage and convey the sample product away.

16. A method according to claim 13 wherein pulses dependent upon material flow speed on the conveyor are generated, the pulses being counted, after detection of the material flow and association of the sample product with the deflection means, for operating the deflection means, and subsequently being counted for operating the gripper to engage and convey the sample product away.

17. A method according to claim 13 wherein association of the sample product with the deflection means is initiated at a target location.

18. A method according to claim 17 wherein association of the sample product with the deflection means can be initiated at each of a plurality of target locations.

19. A method according to claim 13 wherein the cushioning spring is bent and prestressed against the cushioning spring clamp by moving the gripper into a position adjacent the material flow.

20. A method according to claim 13 wherein the cushioning spring is released by moving the cushioning spring clamp out of engagement with the cushioning spring.

* * * * *